US006053430A

United States Patent [19]

Wu et al.

[11] Patent Number: 6,053,430

[45] Date of Patent: Apr. 25, 2000

[54] HORIZONTAL INJECTOR FOR OXIDATION FURNACE

[75] Inventors: Chun-Shen Wu, Taipei; Yu-Shan Tai, Hsinchu; Tien-Jui Liu, Taichung Hsien, all of Taiwan

[73] Assignee: United Microelectronics Corp., Hsin-Chu, Taiwan

[21] Appl. No.: 09/072,319

[22] Filed: May 4, 1998

[30] Foreign Application Priority Data

Mar. 4, 1998 [TW] Taiwan ..... 87103109

[51] Int. Cl.[7] ..... F23D 11/10

[52] U.S. Cl. ..... 239/423; 239/424

[58] Field of Search ..... 239/418, 423, 239/424, 426, 433, 434

[56] References Cited

U.S. PATENT DOCUMENTS

| | | | |
|---|---|---|---|
| 3,552,657 | 1/1971 | Chisholm | 239/424 |
| 4,022,379 | 5/1977 | Ladisch | 239/424 |
| 4,095,929 | 6/1978 | McCartney | 239/424 |
| 4,375,027 | 2/1983 | Zeto et al. | 219/390 |
| 5,299,929 | 4/1994 | Yap | 431/8 |
| 5,445,522 | 8/1995 | Miyagi et al. | 432/156 |
| 5,500,030 | 3/1996 | Joshi et al. | 239/423 |
| 5,620,932 | 4/1997 | Fujimaki | 438/770 |
| 5,714,781 | 2/1998 | Yamamoto et al. | 257/329 |

*Primary Examiner*—Andres Kashnikow
*Assistant Examiner*—Lisa Ann Douglas
*Attorney, Agent, or Firm*—J.C. Patents; Jiawei Huang

[57] ABSTRACT

A horizontal oxidation furnace injector comprising an inner tube and an outer tube. The inner tube has an inner tube inlet and an inner tube outlet. The inner tube inlet is used for receiving a first gas and the inner tube outlet is used for outputting the first gas. The outer tube has a branch tube and an outer tube outlet. The branch tube further includes an outer tube inlet. The outer tube inlet is used for receiving a second gas, and the outer tube outlet is used for outputting the secord gas. Furthermore, the outer tube outlet and the inner tube outlet are at the same end. In addition, part of the inner tube is enclosed by the outer tube of the injector while the remainder of the inner tube is exposed, and the inner tube has no bends.

4 Claims, 1 Drawing Sheet

HORIZONTAL INJECTOR FOR OXIDATION FURNACE

CROSS-REFERENCE TO RELATED APPLICATION

This application claims the priority benefit of Taiwan application Ser. No. 87103109, filed Mar. 4, 1998.

BACKGROUND OF THE INVENTION

1. Field of Invention

The present invention relates to a type of horizontad injector for an oxidation furnace. More particularly, the present invention relate, to an oxidation furnace having a horizontal injector whose hydrogen/nitrogen gas inlet is changed from a side position to a back position to avoid cracking the injector.

2. Description of Related Art

In the fabrication of semiconductor devices, the supply of heat has become an indispensable part of most processes. The most commonly used thermal diffusion equipment, for example, a thermal diffusion furnace, can be classified according to whether it is a horizontal or a vertical type. The horizontal type is the earliest, and is still widely employed in most processes.

Another type of commonly used thermal diffusion equipment is the thermal oxidation furnace. The construction and structure of a thermal oxidation furnace is very similar to a thermal diffusion furnace. A thermal oxidation furnace also can be classified as a horizontal or a vertical type, and both types operate at atmospheric pressure. Beside thermal oxidation furnaces that operate mainly in atmospheric pressure, specially designed high atmospheric pressure oxidation furnaces and plasma-operated oxidation furnaces are available too. However, these types of furnaces are not so commonly used in the semiconductor industry. Therefore, oxidation is still normally carried out using either a horizontal or a vertical atmospheric pressure oxidation furnace.

Fundamentally, oxidation operations can be subdivided into dry oxidation or wet oxidation. Equipment for carrying out a dry oxidation is relatively simple. The only criterion is to allow suitable amounts of passivation gases or nitrogen gas to pass into a heated furnace chamber (roughly at a temperature of above 900° C.). A layer of oxide will begin to grow on the surface of the wafers stationed inside the reaction chamber. On the other hand, equipment for carrying out a wet oxidation reaction is slightly more complicated. As a rule, moisture is not directly used as an agent in the wet oxidation reaction. Rather, gaseous hydrogen and gaseous oxygen are passed into a heated chamber (roughly at a temperature of above 600° C.) to form moisture, and the moisture is indirectly used in the oxidative reaction. Chemical formula (a) below illustrates the chemical reaction involved. As shown in formula (a), water, which is a product of the chemical reaction between hydrogen and oxygen, has an exceptionally high purity. Because of this, the silicon dioxide ($SiO_2$) layer grown on a silicon wafer using a wet oxidation method has better electrical properties. However, the application of moisture generated through reaction (a) for carrying out necessary oxidation is not that simple. This is because gaseous hydrogen is a combustible gas. If gaseous hydrogen is not properly consumed, a pipe explosion may occur. Therefore, the flow of gaseous hydrogen must be handled carefully. In general, a higher furnace temperature is able to prevent the accumulation of unreacted hydrogen, thereby avoiding a hydrogen "explosion" inside the reaction chamber.

$$H_{2(g)} + \frac{1}{2}O_{2(g)} \xrightarrow[\Delta]{} H_2O_{(g)} \quad \text{(a)}$$

The basic structure of a conventional horizontal oxidation furnace is the same as that of a thermal diffusion furnace. Their main difference lies in the design of inlets for introducing gaseous reactant. FIG. 1 is a diagram showing the injector structure of a conventional horizontal oxidation furnace. Since the reaction as shown in formula (a) can easily occur at a high temperature and an oxygen-filled atmosphere, a quartz injector 10 is used. Gaseous hydrogen ($H_2$) and gaseous oxygen ($O_2$) enter the quartz injector 10 through two gaseous inlets 11*b* and 12*b* respectively, and are injected into a pipe furnace 15. Hydrogen passes into the inner pipeline through the gas inlet 11*b* and out of the inner pipeline through a gas outlet 11*c* into the pipe furnace 15. Similarly, gaseous oxygen ($O_2$) passes into the outer pipeline through the gas inlet 12*b* and out of the outer pipeline through a gas outlet 12*c* into the pipe furnace 15.

The conventional injector 10 includes an inner tube 11 and an outer tube 12, wherein the outer tube 12 wraps around the inner tube 11 but exposes a portion of the inner tube 11 outside the outer tube 12 area. The inner tube 11 and the outer tube 12 have branch tubes 11*a* and 12*a* and gas outlets 11*c* and 12*c*, respectively. Furthermore, the branch tube 11*a* has an inner tube inlet 11*b*, and the branch tube 12*a* has an outer tube inlet 12*b*. The branch tube 11*a* is perpendicular to the inner tube 11, and the branch tube 12*a* is perpendicular to the outer tube 12.

Before starting a wet oxidation reaction, oxygen is first passed into the pipe furnace 15 until the whole furnace 15 is oxygen-filled. Next, a suitable amount of hydrogen is injected into the furnace 15 through the inner tube inlet 11*b* and inner tube outlet 11*c* of the injector 10. Because the furnace already, has a sufficient amount of oxygen inside, the reaction indicated by formula (a) can be carried out. To avoid an explosion caused by a shortage of oxygen or the accumulation of hydrogen, the amount of oxygen flowing into the furnace 15 must be maintained at slightly more than half the amount of hydrogen going into the furnace. In other words, since the rate of consumption of hydrogen and oxygen is in a molar ratio of 1:½, a slight excess of oxygen must be maintained inside the furnace throughout the wet oxidation operation. Similarly, when wet oxidation is finished, although the inflow of hydrogen has stopped, oxygen must still be supplied for quite awhile so that all the remaining hydrogen inside the furnace can react with oxygen. Finally, nitrogen is passed into the furnace 15 via the inner tube 11 while the furnace 15 is allowed to cool down.

The above description shows that even when the wet oxidation process has finished and inflow of hydrogen has stopped, oxygen needs to be supplied for a certain period more so that all the remaining hydrogen inside the furnace has reacted. However, the continuous supply of oxygen to the furnace has the adverse effect of flowing back through the inner tube 11 into the inner branch tube 11*a*. Hence, an explosive force caused by the oxygen/hydrogen mixture will be transmitted to the junction area 13 where the inner tube and the branch tube 11*a* are joined together. Consequently, the junction area 13 can be easily fractured.

Furthermore, as shown in FIG. 1, the conventional injection 10 has a side hydrogen/nitrogen ($H_2/N_2$) gas inlet, and the fusing of a side inlet to the main tube can add a lot of internal stress at the junction. Therefore, the junction area of the injection 10 is rather weak and can easily crack when subjected to a minor explosive force.

In summary, the conventional injector structure has the following defects:

(1) Because the branch tube is connected on one side of the inner tube, most of the explosive force is concentrated there. Therefore, the junction area can easily break.

(2) The hydrogen/nitrogen gas inlet of a conventional injector is attached to one side by fusion. Therefore, the fusion area has a lot of accumulated internal stress, which can easily be ruptured by slight explosive pressure.

In light of the foregoing, there is a need to produce a better injector design.

SUMMARY OF THE INVENTION

Accordingly, the present invention is to provide an injector for a horizontal oxidation furnace. The injector has a hydrogen/nitrogen inlet that is back-connected rather than side-connected. Therefore, internal stress build-up due to fusing a branch tube, which can weaken the injector structure, is reduced.

In another aspect, this invention provides an injector for a horizontal oxidation furnace that avoids the excessive explosive pressure at the junction of the side-connected gas inlet, as seen when hydrogen is ignited in a furnace of conventional design. Hence, breakage due to pressure build-up at the junction can be minimized.

To achieve these and other advantages and in accordance with the purpose of the invention, as embodied and broadly described herein, the invention provides an injector for a horizontal oxidation furnace comprising an inner tube and an outer tube. The inner tube has an inner tube inlet and an inner tube outlet. The inner tube inlet is used for receiving a first gas and the inner tube outlet is used for outputting the first gas. The outer tube has a branch tube and an outer tube outlet. The branch tube further includes an outer tube inlet. The outer tube inlet is used for receiving a second gas and the outer tube outlet is used for outputting the second gas. Furthermore, the outer tube outlet and the inner tube outlet are at the same end. In addition, part of the inner tube is enclosed by the outer tube of the injector while the rest of the inner tube is exposed, and the inner tube has no bends.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
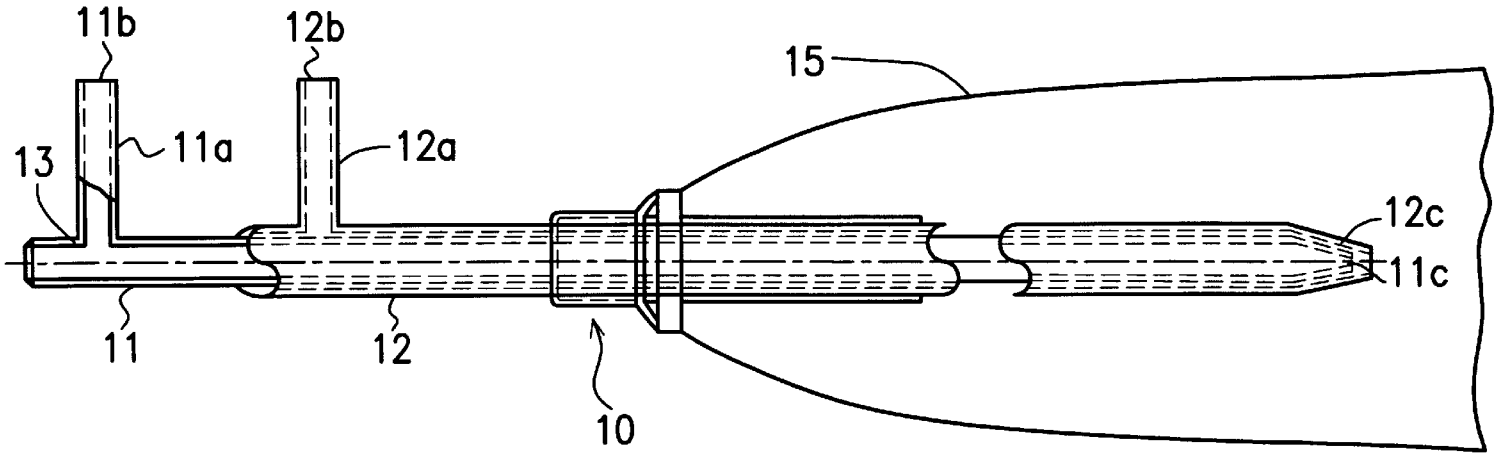
FIG. 1 (PRIOR ART)
FIG. 1 is a diagram showing the injector structure of a conventional horizontal oxidation furnace.

Reference will now be made in detail to the present preferred embodiments of the invention, examples of which are illustrated in the accompanying drawings. Wherever possible, the same reference numbers are used in the drawings and the description to refer to the same or like parts.

Figure 2:
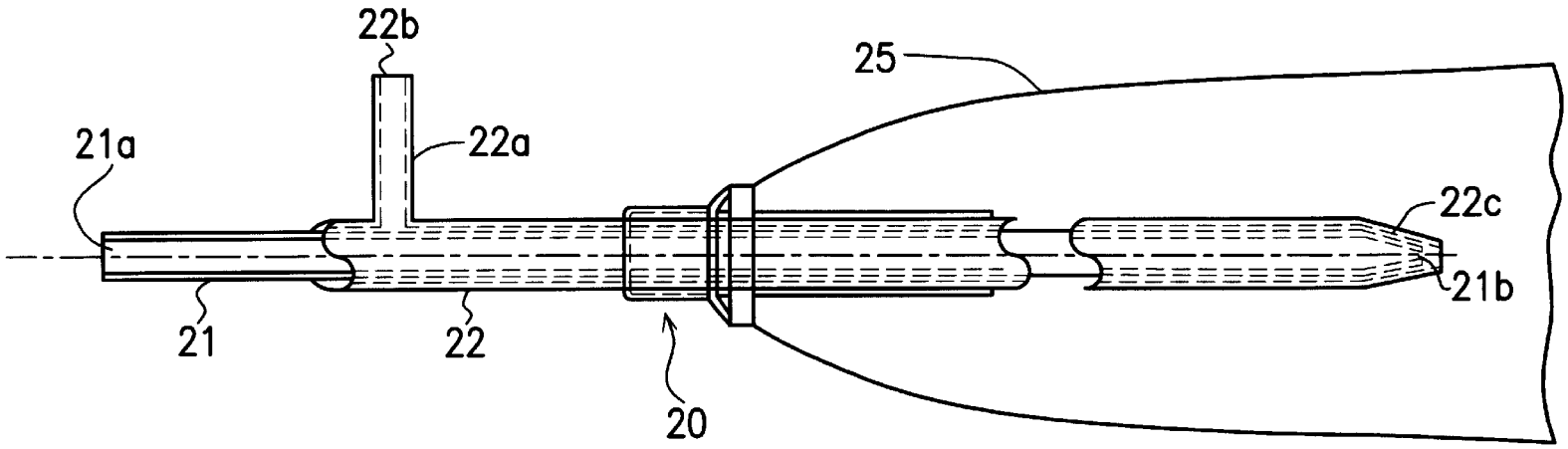
FIG. 2 is a diagram shows the injector structure of a horizontal oxidation furnace according to one preferred embodiment of this invention.

FIG. 2 is a diagram shows the injector structure of a horizontal oxidation furnace according to one preferred embodiment of this invention. Injector 20 is made from a material such as quartz. As shown in FIG. 2, the injector 20 has a structural design very similar to the conventional injector 10 design shown in FIG. 1. In fact, the only difference between a conventional design and this invention is that the gas inlet position for the inflow of hydrogen/nitrogen ($H_2/N_2$) gas is different. This invention has a back-connected inlet rather than a side-connected inlet.

The injector 20 includes an inner tube 21 and an outer tube 22. The outer tube 22 encloses only a portion of the inner tube 21, while the remaining portion of the inner tube 21 is exposed. The outer tube 22 includes a branch tube 22*a* and an outer tube outlet 22*c*. The branch tube 22*a* further includes an outer tube inlet 22*b*. The branch tube 22*a* is perpendicular to the outer tube 22. In addition, the inner tube 21 has an inner tube inlet 21*a* and an inner tube outlet 21*b*.

According to conventional wet oxidation operation, although the supply of hydrogen is stopped when wet oxidation is finished, the supply of oxygen needs to be continued for a period of time so that the remaining hydrogen inside the furnace 25 can fully react. Finally, nitrogen passing from the inner tube inlet 21*a* to the inner tube outlet 21*b* is injected to the furnace 25 while the furnace 25 is allowed to cool down.

The process of continuously feeding oxygen into the furnace 25 after the supply of hydrogen has terminated at the end of a wet oxidation reaction is essential. For a conventional injector design as shown in FIG. 1, since the hydrogen/nitrogen inlet is side-connected, junction area 13 between the inner tube 11 and the branch tube 11*a* is subjected to an explosive force. This can easily crack open the tube near the junction area 13.

However, as shown in FIG. 2, the hydrogen/nitrogen inlet tube of the injector 20 is back-connected. Therefore, the problem of cracking it the junction area 13 of a conventional injector design will not be encountered.

Furthermore, since the hydrogen-nitrogen inlet tube of the injector 20 is back-connected, there is no need for fusing on an additional blanch tube. Hence, internal stress created by the fusion process, which may lead to the fracturing of the injector due to an explosive pressure, does not exist.

In summary, the advantages of using an injector design according to this invention includes:

(1) The hydrogen/nitrogen inlet tube of the injector is back-connected rather than side-connected. Hence, internal stress caused by fusing a branch tube to the injector (quartz) is eliminated.

(2) With a back-connected rather than a side-connected hydrogen/nitrogen tube, any explosive force due to the ignition of hydrogen, which could lead to a breakage of the injector, will not be concentrated at a junction area.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A horizontal oxidation furnace injector for an oxidation furnace, comprising:

an inner tube having an inner tube inlet and an inner tube outlet, where the inner tube inlet is used for receiving a first gas and a second gas, and the inner tube outlet is used for outputting the first gas and the second gas; and an outer tube having a branch tube and an outer tube outlet, the branch tube further including an outer tuber inlet, wherein the outer tube inlet is used for receiving a third gas, the outer tube outlet is used for outputting the third gas, and the outer tube outlet and the inner tube outlet are located at the same end; wherein when a wet oxidation is performed, an amount of the third gas flowing must be maintained at more than half an amount of the first gas flowing; and when the wet oxidation is finished, the flow of the first gas is stopped, the third gas must still be supplied, and the second gas is passed into the oxidation furnace.

2. The injector of claim 1, wherein the first gas includes hydrogen.

3. The injector of claim 1, wherein the second gas includes nitrogen.

4. The injector of claim 1, wherein the third gas includes oxygen.

* * * * *